US010991323B2

(12) United States Patent
Wang et al.

(10) Patent No.: US 10,991,323 B2
(45) Date of Patent: Apr. 27, 2021

(54) CONTROL CIRCUIT, TESTING APPARATUS AND METHOD FOR LIQUID CRYSTAL DISPLAY PANEL

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Weiwei Wang, Beijing (CN); You Zheng, Beijing (CN); Wenhua Fu, Beijing (CN); Yanli Lou, Beijing (CN); Qing Wang, Beijing (CN); Xiaofen Wang, Beijing (CN); Xin Shao, Beijing (CN); Gan Ren, Beijing (CN); Jian Zhang, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 103 days.

(21) Appl. No.: 16/482,028

(22) PCT Filed: Dec. 12, 2018

(86) PCT No.: PCT/CN2018/120507
§ 371 (c)(1),
(2) Date: Jul. 30, 2019

(87) PCT Pub. No.: WO2019/184449
PCT Pub. Date: Oct. 3, 2019

(65) Prior Publication Data

US 2020/0357350 A1 Nov. 12, 2020

(30) Foreign Application Priority Data

Mar. 27, 2018 (CN) ..... 201810259258.1

(51) Int. Cl.
*G09G 3/36* (2006.01)

(52) U.S. Cl.
CPC ..... *G09G 3/36* (2013.01); *G09G 2310/06* (2013.01); *G09G 2320/0247* (2013.01); *G09G 2330/12* (2013.01)

(58) Field of Classification Search
CPC ..... G09G 2320/0247; G09G 2330/12; G09G 2310/06; G09G 3/00; G09G 3/36
See application file for complete search history.

(56) References Cited

U.S. PATENT DOCUMENTS 5,717,418 A 2/1998 Shapiro et al.
2005/0083272 A1 4/2005 Kimura
(Continued)

FOREIGN PATENT DOCUMENTS

CN 1577459 A 2/2005
CN 1648753 A 8/2005
(Continued)

*Primary Examiner* — Priyank J Shah
(74) *Attorney, Agent, or Firm* — Myers Bigel, P.A.

(57) ABSTRACT

A control circuit, a testing apparatus and a method for testing a liquid crystal display panel are provided. The control circuit includes a current sensor and a discharge signal generation circuit. The current sensor is configured to detect a change in an input current of the liquid crystal display panel to generate an indication signal, the indication signal being indicative of switching of image frames displayed by the liquid crystal display panel. The discharge signal generation circuit is configured to receive the indication signal from the current sensor, and the discharge signal generation circuit generates a discharge signal in response to receiving the indication signal, so that a liquid crystal capacitor including the common electrode and the pixel electrode in the liquid crystal display panel is discharged. Hence, the quality of images displayed by the liquid crystal display
(Continued)

panel can be improved and the product yield can be increased.

20 Claims, 2 Drawing Sheets

(56) References Cited

U.S. PATENT DOCUMENTS

| | | | | |
|---|---|---|---|---|
| 2006/0022932 | A1 | 2/2006 | Sagawa et al. | |
| 2010/0026730 | A1 | 2/2010 | Okutani | |
| 2010/0039425 | A1* | 2/2010 | Chen | G09G 3/3659 345/214 |
| 2015/0325188 | A1 | 11/2015 | Wei et al. | |
| 2016/0141312 | A1* | 5/2016 | Nakatani | H01L 27/1225 349/43 |
| 2017/0256213 | A1 | 9/2017 | Zhang | |

FOREIGN PATENT DOCUMENTS

| | | | |
|---|---|---|---|
| CN | 1734533 | A | 2/2006 |
| CN | 101640035 | A | 2/2010 |
| CN | 103995407 | A | 8/2014 |
| CN | 104965364 | A | 10/2015 |
| CN | 105161065 | A | 12/2015 |

* cited by examiner

CONTROL CIRCUIT, TESTING APPARATUS AND METHOD FOR LIQUID CRYSTAL DISPLAY PANEL

RELATED APPLICATION

The present application is a 35 U.S.C. 371 national stage application of PCT International Application No. PCT/CN2018/120507, filed on Dec. 12, 2018, which claims the benefit of Chinese Patent Application No. 201810259258.1, filed on Mar. 27, 2018, the entire disclosure of which is incorporated herein by reference.

TECHNICAL FIELD

The present disclosure relates to the field of display technologies, and particularly to a control circuit, a testing apparatus and a testing method for a liquid crystal display panel.

BACKGROUND

With the advancement of technology and the improvement of people's living standards, there is an increasing demand for image display quality of electronic display devices. For example, higher resolution or refresh rate is always expected. Since the electron mobility of an oxide is much higher than that of amorphous silicon, oxide semiconductor transistors are widely used in the existing display devices.

Before leaving factory, a manufactured display panel generally needs to go through a testing process. For example, a lighting test is performed to display panels to eliminate unqualified products. However, in practice, for those display panels that have been tested and considered to be qualified products, poor display quality may still appear. For example, phenomena such as flickers, black and white spots (mura), and the like may occur on the screen when an image is being displayed.

SUMMARY

A control circuit for a liquid crystal display panel provided by an embodiment of the present disclosure comprises: a current sensor configured to detect a change in an input current of the liquid crystal display panel to generate an indication signal, the indication signal being indicative of switching of image frames displayed by the liquid crystal display panel, and a discharge signal generation circuit configured to receive the indication signal from the current sensor, the discharge signal generation circuit generating a discharge signal in response to receiving the indication signal so that a liquid crystal capacitor comprising the common electrode and the pixel electrode in the liquid crystal display panel is discharged.

In some embodiments, the indication signal is a first pulse signal having a first duration, the discharge signal is a second pulse signal having a second duration equal to the first duration, the second pulse signal causes the liquid crystal capacitor to be discharged within the second duration.

In some embodiments, the control circuit further comprises a discharge control circuit that causes the liquid crystal capacitor to be discharged in response to receiving the second pulse signal.

In some embodiments, the discharge control circuit comprises a processor and a level selection circuit, the level selection circuit comprises a first transistor and a second transistor, a first terminal of the first transistor is electrically connected to a second terminal of the second transistor, the second terminal of the second transistor is configured to receive a high level signal, a first terminal of the second transistor is configured to receive a low level signal, control terminals of the first transistor and the second transistor are electrically connected to an output terminal of the processor, an input terminal of the processor is configured to receive the second pulse signal.

In some embodiments, the discharge signal generation circuit comprises a second pulse signal generation circuit and a third pulse signal generation circuit, the third pulse signal generation circuit is configured to receive the first pulse signal to generate a third pulse signal, the second pulse signal generation circuit is configured to receive the third pulse signal to generate the second pulse signal, a third duration of the third pulse signal is equal to the first duration, a pulse amplitude of the second pulse signal is greater than a pulse amplitude of the third pulse signal.

In some embodiments, the third pulse signal generation circuit comprises an optical coupler and a first capacitor, an input terminal of the optical coupler is configured to receive the first pulse signal, the first capacitor is electrically connected to an output terminal of the optical coupler.

In some embodiments, the second pulse signal generation circuit comprises a relay and a driving circuit, the driving circuit is configured to receive the third pulse signal to drive the relay to output the second pulse signal.

In some embodiments, the current sensor generates the indication signal in response to a magnitude of the change in the input current exceeding 10%.

Another embodiment of the disclosure provides a testing apparatus for a liquid crystal display panel, comprising the control circuit according to any one of foregoing embodiments.

In some embodiments, the testing apparatus comprises a voltage input port for receiving an external supply voltage and a voltage output port for providing a working voltage to the liquid crystal display panel to generate the input current, wherein the current sensor is electrically connected between the voltage input port and the voltage output port to detect the change in the input current.

In some embodiments, the testing apparatus comprises an image signal output interface for being electrically connected to the liquid crystal display panel to provide an image signal to the liquid crystal display panel.

A further embodiment of the disclosure provides a method for testing a liquid crystal display panel, the liquid crystal display panel comprising a common electrode and a pixel electrode, the method comprises: providing an image signal to the liquid crystal display panel for image display; detecting a change in an input current of the liquid crystal display panel to determine whether switching of image frames occurs, and discharging a liquid crystal capacitor comprising a common electrode and a pixel electrode in the liquid crystal display panel in response to detecting that switching of image frames occurs.

In some embodiments, the method comprises detecting the change in the input current and generating a first pulse signal having a first duration by a current sensor, the first pulse signal indicating that switching of image frames occurs, and generating a second pulse signal having a second duration equal to the first duration in response to generating the first pulse signal, the second pulse signal causing the liquid crystal capacitor to be discharged within the second duration.

In some embodiments, the liquid crystal display panel comprises a discharge switch and a discharge control circuit connected in series with the liquid crystal capacitor, the method further comprises providing the second pulse signal to the discharge control circuit, the discharge control circuit turning on the discharge switch in response to receiving the second pulse signal.

In some embodiments, the method further comprises generating a third pulse signal based on the first pulse signal prior to generating the second pulse signal, a third duration of the third pulse signal being equal to the first duration; and generating the second pulse signal based on the third pulse signal, a pulse amplitude of the second pulse signal being greater than a pulse amplitude of the third pulse signal.

DETAILED DESCRIPTION OF EMBODIMENTS

Specific embodiments of the disclosure will be described in detail below by way of examples. It is to be understood that embodiments of the present disclosure are not limited to the examples exemplified below, and those skilled in the art can make modifications and variations to the embodiments herein with the principle or spirit revealed by the disclosure to obtain other embodiments in different forms. It is apparent that these embodiments all fall within the scope of the present application.

Figure 1:
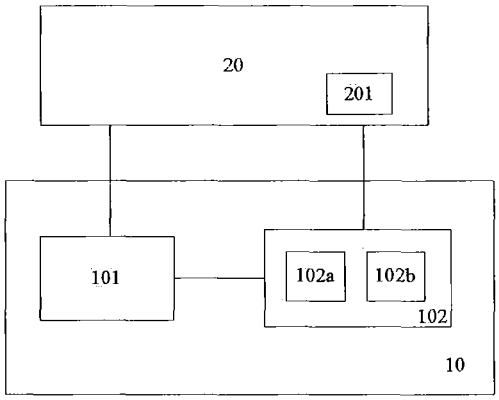
FIG. 1 schematically shows block diagrams of a control circuit and a display panel according to an embodiment of the present disclosure.

FIG. 1 schematically shows block diagrams of a control circuit 10 for a liquid crystal display panel and a liquid crystal display panel 20 according to an embodiment of the disclosure. The control circuit 10 comprises a current sensor 101 and a discharge signal generation circuit 102. The current sensor 101 is configured to detect a change in an input current of the liquid crystal display panel 20 to generate an indication signal indicative of switching of image frames displayed by the liquid crystal display panel. The discharge signal generation circuit 102 is configured to receive the indication signal from the current sensor 101, and the discharge signal generation circuit 102 generates a discharge signal in response to receiving the indication signal, so that a liquid crystal capacitor comprising a common electrode and a pixel electrode in the liquid crystal display panel 20 is discharged. FIG. 1 further illustrates that the display panel 20 comprises a discharge control circuit 201 for controlling discharging of the liquid crystal capacitor in the display panel.

The control circuit proposed by the embodiment of the disclosure can be applied in a testing process of the liquid crystal display panel, such as a lighting testing process before leaving factory, which can improve the quality of images displayed by the liquid crystal display panel and further improve the product yield. Next, the principle that the control circuit proposed by the embodiment of the disclosure can improve the quality of images displayed by the liquid crystal display panel will be specifically discussed.

Figure 2:
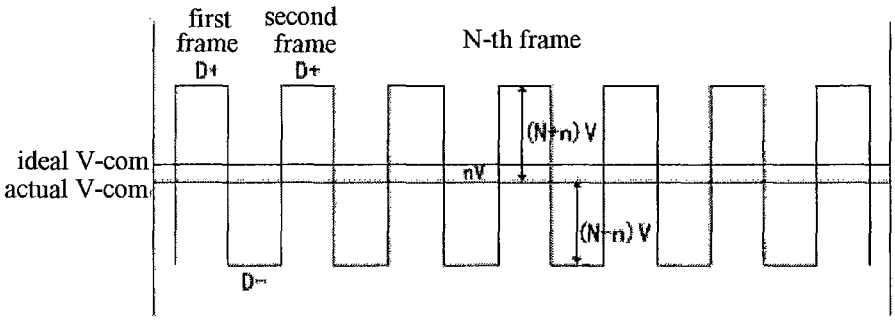
FIG. 2 is used to illustrate a charge transfer phenomenon occurring in a liquid crystal display panel during a testing process.

The potential of the common electrode in the liquid crystal display panel generally serves as a reference potential, and the potential of the pixel electrode is dependent on an image data signal. The image data signal is typically a varying signal, the value of which may be higher or lower than the reference potential of the common electrode. That is to say, if the reference potential of the common electrode is deemed as a reference, an image data signal comprises a data signal having a positive value and a data signal having a negative value, and data signals of images of different frames may also be different, as shown in FIG. 2.

Inventors of the present application have recognized that, for a varying image data signal having a positive amplitude and a negative amplitude (e.g., D+and D− in FIG. 2), an ideal value of the common electrode potential (V-com) should have the following characteristics: the difference between the common electrode potential and the positive data signal D+ is equal to the difference between the common electrode potential and the negative data signal D−. However, in practical production, especially during a testing process of the liquid crystal display panel, it is difficult to maintain the above-mentioned ideal value for the common electrode potential. For example, as shown in FIG. 2, an actual common electrode potential may be lower than the ideal common electrode potential (e.g., the difference is n), so that the potential of the positive data signal D+ with respect to the reference potential is (N+n) V, and the potential of the negative data signal D− with respect to the reference potential is (N−n) V. Therefore, when the common electrode potential deviates from the above ideal value, the positive data signal and the negative data signal will have different absolute values, which may cause an imbalance in the voltage for controlling deflection of the liquid crystal molecules during the lighting testing process, thereby resulting in charge transfer between liquid crystal capacitors and storage of charges on the common electrode. This charge transfer may continue to take place as images of different frames are displayed during the testing process. Therefore, inventors of the present applicant have recognized that a large amount of charges may be stored on the common electrode during the existing testing process for the liquid crystal display panel, which is disadvantageous for displaying images on a liquid crystal display panel, and may lead to unpleasant phenomena such as flickers, black and white spots, and the like.

If the control circuit proposed by the embodiment of the present disclosure is applied to the testing process of a liquid crystal display panel, poor display caused by storage of a large amount of charges on the common electrode can be mitigated or alleviated. The current sensor of the control circuit can generate an indication signal indicating that switching of image frames displayed by the liquid crystal display panel occurs by detecting a change in the input current of the liquid crystal display panel. Upon receiving the indication signal, the discharge signal generation circuit generates a discharge signal that is provided to the display panel.

The discharge signal may be received, for example, by a discharge control circuit on the display panel, so that the liquid crystal capacitor of the liquid crystal display panel is discharged. Therefore, by applying the control circuit provided by the embodiment of the present disclosure to the testing process of a liquid crystal display panel, a discharging process can be performed once on the liquid crystal capacitor between the time periods in which images of different frames are displayed, which can prevent a large amount of charges from accumulating on the common electrode and improve the quality of images displayed on the liquid crystal display panel.

It can be understood that different currents are required for the liquid crystal display panel to display images of different frames. Therefore, it can be judged whether the displayed image frames are switched by detecting a change in the input current of the liquid crystal display panel. In an embodiment, the current sensor is configured to generate an indication signal upon detecting that the magnitude of the change in the input current exceeds a threshold (e.g., 10%). That is, if the magnitude of the change in the input current is detected to exceed the threshold, it is considered that switching of image frames has occurred, and an image of the next frame is to be displayed. This can avoid erroneous detection of switching of image frames. In an example, the current sensor may be disposed in a power circuit of the liquid crystal display panel. For example, the current sensor may be connected in series in a power supply line that provides a working voltage to the liquid crystal display panel.

In an embodiment, the indication signal outputted by the current sensor is a first pulse signal P1 having a first duration, and the discharge signal is a second pulse signal P2 having a second duration equal to the first duration, which enables the liquid crystal capacitor to be discharged within the second duration. That is to say, the discharge signal is generated in response to the indication signal, and also ends with the end of the indication signal, such that the liquid crystal capacitor is discharged only in a short time period during which switching of image frames occurs, which can avoid or decrease the impact on images normally displayed by the liquid crystal display panel.

Figure 3:
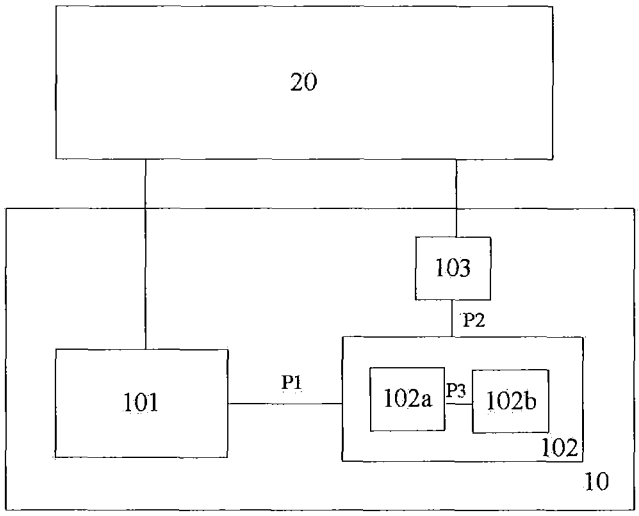
FIG. 3 schematically shows block diagrams of a control circuit and a display panel according to another embodiment of the present disclosure.

As previously mentioned, the discharge control circuit for controlling discharging of the liquid crystal capacitor in the display panel may be disposed in the liquid crystal display panel. However, alternatively, the discharge control circuit may also be disposed in the control circuit. As shown in FIG. 3, the control circuit 10 further comprises a discharge control circuit 103 that discharges the liquid crystal capacitor in response to receiving a discharge signal (i.e., the second pulse signal P2) from the discharge signal generation circuit 102.

Figure 4:
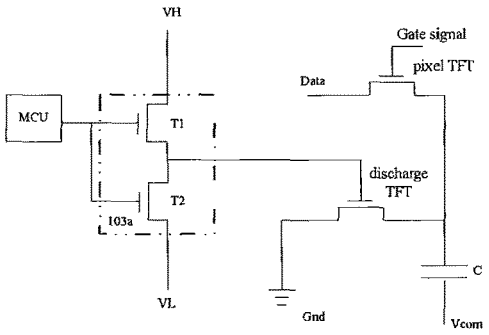
FIG. 4 schematically shows a discharge control circuit and a discharge loop of a liquid crystal capacitor according to an embodiment of the present disclosure.

FIG. 4 shows an example of the discharge control circuit. In order to more clearly understand the discharging process of the liquid crystal capacitor, FIG. 4 also schematically shows a liquid crystal capacitor C and a discharge circuit. As shown in FIG. 4, the discharge circuit of the liquid crystal capacitor comprises a discharge switch (for example, a TFT) connected in series thereto, and one terminal of the liquid crystal capacitor C is electrically connected to a pixel switch (for example, a TFT) to receive a data signal data. An example of the discharge control circuit 103 comprises a processor MCU and a level selection circuit 103*a* controlled by the processor. The processor MCU may be electrically connected to the discharge signal generation circuit 102 to receive the discharge signal from the discharge signal generation circuit. In the example of FIG. 4, the level selection circuit 103*a* comprises a first transistor T1 and a second transistor T2 electrically connected in series. The first transistor is configured to receive a high level signal VH and the second transistor is configured to receive a low level signal VL. In an embodiment of the disclosure, the high level signal VH is, for example, a positive potential signal having a constant amplitude, for example, 1.8 V, 3.3 V, etc., and the low level signal VL is, for example, a zero potential signal or a negative potential signal having a constant amplitude, for example −1.8 V, −3.3 V, etc. When the processor does not receive the discharge signal from the discharge signal generation circuit, it controls the first transistor T1 to be turned off and the second transistor T2 to be turned on, thereby outputting a low level signal to the control terminal of the discharge TFT to maintain the discharge TFT in a turn-off state (in this example, the discharge TFT is an N-type TFT). When the processor receives the discharge signal from the discharge signal generation circuit, it can control the first transistor T1 to be turned on and the second transistor T2 to be turned off. At that time, the control terminal of the discharge TFT receives a high level VH, and the discharge TFT is turned on, thereby discharging the liquid crystal capacitor. Of course, FIG. 4 only shows an example of the discharge control circuit. Those skilled in the art can devise many alternative solutions of the discharge control circuits based on the principles revealed herein, and these alternative solutions are all encompassed within the spirit of the present disclosure and fall within the scope of the present application.

Next, embodiments of the discharge signal generation circuit will be described by way of example. In some embodiments, the discharge signal generation circuit comprises a second pulse signal generation circuit 102*b* and a third pulse signal generation circuit 102*a*. As shown in FIG. 3, the third pulse signal generation circuit 102*a* is configured to receive the first pulse signal P1 to generate a third pulse signal P3, and the second pulse signal generation circuit is configured to receive the third pulse signal P3 to generate the second pulse signal P2. The third pulse signal having a third duration equal to the first duration, and the pulse amplitude of the second pulse signal is greater than that of the third pulse signal.

Figure 5:
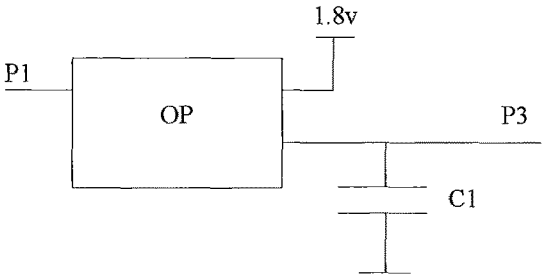
FIG. 5 schematically shows a third pulse signal generation circuit in a control circuit according to an embodiment of the present disclosure.

In an embodiment, as shown in FIG. 5, the third pulse signal generation circuit comprises an optical coupler OP and a first capacitor C1. The input terminal of the optical coupler OP is configured to receive the first pulse signal P1, and the first capacitor C1 is electrically connected to the output terminal of the optical coupler to generate the second pulse signal P2 at the output terminal of the optical coupler. For the third pulse signal generation circuit shown in FIG. 5, it can be understood that when the input terminal of the optical coupler OP does not receive the first pulse signal, the output terminal of the optical coupler is not connected with a first fixed level (for example, 1.8 V) signal receiving terminal, and does not output a signal. When the input terminal of the optical coupler OP receives the first pulse signal P1, the output terminal of the optical coupler is connected with the first fixed level signal receiving terminal to generate a voltage signal. The capacitor C1 may be discharged as the first pulse signal P1 ends, thereby generating a third pulse signal. It can be understood that the resistance of the discharge loop in which the capacitor C1 is located can be designed to control the discharge time of the capacitor C1 such that the third duration of the third pulse signal is equal to the first duration. Therefore, in this example, the amplitude of the third pulse signal is approximately 1.8 V.

Figure 6:
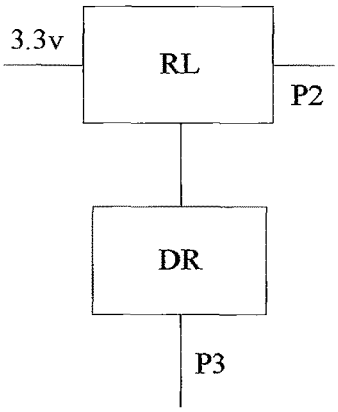
FIG. 6 schematically shows a second pulse signal generation circuit in a control circuit according to an embodiment of the present disclosure.

In an embodiment, the second pulse signal generation circuit 102*b* comprises a relay and a driving circuit thereof. As shown in FIG. 6, a driving circuit DR receives the third pulse signal P3 and drives the relay RL to output the second pulse signal P2. In the example of FIG. 6, when the driving circuit DR does not receive the third pulse signal P3, the output terminal of the relay is not connected with a second fixed level (for example, 3.3 V) signal receiving terminal. When the driving circuit DR receives the third pulse signal P3, it controls the output terminal of the relay to be connected with the second fixed level signal receiving terminal such that a second fixed level signal is outputted from the output terminal of the relay. The driving circuit DR may comprise a switch controlled by the third pulse signal P3, and when the third pulse signal P3 ends, the output terminal of the relay is also disconnected from the second fixed level signal receiving terminal. In this example, the amplitude of the third pulse signal is 3.3 V.

In the above-described embodiment comprising the second pulse signal generation circuit 102*b* and the third pulse signal generation circuit 102*a*, the indication signal from the current sensor is actually converted into the second pulse signal having a larger amplitude, and the second pulse signal having a larger amplitude is not obtained by directly amplifying the indication signal outputted by the current sensor. The second pulse signal is generated in response to the indication signal, but is independent of the indication signal of the current sensor, which is advantageous for improving the accuracy of controlling discharging of the liquid crystal capacitor by the discharge control circuit in response to the indication signal from the current sensor.

Regarding the first fixed level signal and the second fixed level signal mentioned above, they may be provided by an external circuit or may be implemented inside the control circuit. For example, the control circuit may comprise a power conversion circuit which can receive an external supply voltage to generate DC voltages of different amplitudes, for example, 1.8 V, 3.3 V, and can further generate working voltages required by the circuit units inside the control circuit.

Figure 7:
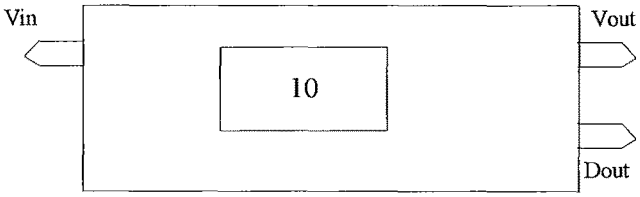
FIG. 7 schematically shows a block diagram of a testing apparatus for a liquid crystal display panel according to an embodiment of the present disclosure.

As described above, the control circuit provided by the embodiment of the disclosure can be applied to a testing process of a liquid crystal display panel, and in particular, the control circuit can control the liquid crystal capacitor in the liquid crystal display panel to be discharged during the testing process. Accordingly, another embodiment of the present disclosure provides a testing apparatus for a liquid crystal display panel, the testing apparatus comprises the control circuit described in any of the foregoing embodiments. As shown in FIG. 7, the testing apparatus of the liquid crystal display panel comprises the control circuit 10 described in any of the foregoing embodiments, and the testing apparatus can perform testing to a finished liquid crystal display panel to increase the product yield. The testing apparatus may be present in various forms, for example, the testing apparatus may be in the form of a test board.

In some embodiments, as shown in FIG. 7, the testing apparatus comprises a voltage input port Vin for receiving an external voltage and a voltage output port Vout for providing a working voltage to the liquid crystal display panel to generate the input current to be detected by the current sensor. The current sensor may be electrically connected between the voltage input port and the voltage output port to detect a change in the input current. Further, as shown in FIG. 7, the testing apparatus comprises an image signal output interface Dout for being electrically connected to the liquid crystal display panel to provide an image signal to the liquid crystal display panel.

Using the testing apparatus provided by the embodiment of the present disclosure to test the liquid crystal display panel, the liquid crystal capacitor in the liquid crystal display panel may be discharged for a short time during the testing process, in this way, charges accumulated on the common electrode at least can be reduced. This is beneficial to improvement of the quality of images displayed by the liquid crystal display panel after leaving factory, and further increases the product yield.

Accordingly, a further embodiment of the present disclosure provides a method for testing a liquid crystal display panel, which comprises the following steps: providing an image signal to the liquid crystal display panel for image display; detecting a change in an input current of the liquid crystal display panel to determine whether switching of image frames occurs; discharging a liquid crystal capacitor comprising a common electrode and a pixel electrode in the liquid crystal display panel in response to detecting that switching of image frames occurs.

Further, in the method provided by an embodiment of the disclosure, a current sensor may be used to detect the change in the input current and generate a first pulse signal having a first duration, and the first pulse signal is indicative of switching of image frames displayed by the liquid crystal display panel. The method may comprise generating, in response to the first pulse signal being generated, a second pulse signal having a second duration equal to the first duration, the second pulse signal causing the liquid crystal capacitor to be discharged within the second duration.

In some embodiments, the liquid crystal display panel comprises a discharge switch and a discharge control circuit connected in series with the liquid crystal capacitor. The method comprises providing the second pulse signal to the discharge control circuit, the discharge control circuit turning on the discharge switch in response to receiving the second pulse signal. At that time, the liquid crystal capacitor may be discharged through the discharge circuit in which the discharge switch is located within the duration of the second pulse signal, thereby reducing or eliminating charges accumulated on the common electrode.

In another embodiment, the method may further comprise: generating a third pulse signal based on the first pulse signal prior to generating the second pulse signal, the third duration of the third pulse signal being equal to the first duration; generating the second pulse signal based on the third pulse signal, the pulse amplitude of the second pulse signal being greater than that of the third pulse signal.

Moreover, it will be understood by those skilled in the art that "equal" as used herein does not necessarily mean being absolutely equal, it also means "being approximately equal" or "being substantially equal." For example, considering the factors such as signal delay, external environmental interference, and the like, the first duration of the first pulse signal, the second duration of the second pulse signal, and the third duration of the third pulse signal may not be absolutely equal. For example, in some embodiments, they may have a difference of milliseconds between each other.

Embodiments of the method for testing a liquid crystal display panel proposed by the disclosure have similar technical effects as the foregoing embodiments of the control circuit and the testing apparatus, and details are not described herein again.

Some exemplary embodiments of the present disclosure have been specifically described above. However, those skilled in the art can understand and implement other variants of the disclosed embodiments by studying the drawings, description and claims when practicing the claimed subject matters. In the claims, the word such as "comprise" does not exclude the presence of other elements, and the claims do not limit the number of any of the technical features recited. Although some features are recited in different dependent claims, the present application is also intended to cover embodiments in which these features are combined.

The invention claimed is:

1. A control circuit for a liquid crystal display panel, the liquid crystal display panel comprising a common electrode and a pixel electrode, wherein the control circuit comprises:

a current sensor configured to detect a change in an input current of the liquid crystal display panel to generate an indication signal, wherein the indication signal is indicative of switching of image frames displayed by the liquid crystal display panel, and a discharge signal generation circuit configured to receive the indication signal from the current sensor, wherein the discharge signal generation circuit generates a discharge signal in response to receiving the indication signal so that a liquid crystal capacitor comprising the common electrode and the pixel electrode in the liquid crystal display panel is discharged.

2. The control circuit according to claim 1, wherein the indication signal is a first pulse signal having a first duration, wherein the discharge signal is a second pulse signal having a second duration equal to the first duration, and wherein the second pulse signal is configured to cause the liquid crystal capacitor to be discharged within the second duration.

3. The control circuit according to claim 2, wherein the control circuit further comprises a discharge control circuit that is configured to cause the liquid crystal capacitor to be discharged in response to receiving the second pulse signal.

4. The control circuit according to claim 3, wherein the discharge control circuit comprises a processor and a level selection circuit, wherein the level selection circuit comprises a first transistor and a second transistor, wherein a first terminal of the first transistor is electrically connected to a second terminal of the second transistor, wherein the second terminal of the second transistor is configured to receive a high level signal, wherein a first terminal of the second transistor is configured to receive a low level signal, wherein control terminals of the first transistor and the second transistor are electrically connected to an output terminal of the processor, and wherein an input terminal of the processor is configured to receive the second pulse signal.

5. The control circuit according to claim 2, wherein the discharge signal generation circuit comprises a second pulse signal generation circuit and a third pulse signal generation circuit, wherein the third pulse signal generation circuit is configured to receive the first pulse signal to generate a third pulse signal, wherein the second pulse signal generation circuit is configured to receive the third pulse signal to generate the second pulse signal, wherein a third duration of the third pulse signal is equal to the first duration, and wherein a pulse amplitude of the second pulse signal is greater than a pulse amplitude of the third pulse signal.

6. The control circuit according to claim 5, wherein the third pulse signal generation circuit comprises an optical coupler and a first capacitor, wherein an input terminal of the optical coupler is configured to receive the first pulse signal, and wherein the first capacitor is electrically connected to an output terminal of the optical coupler.

7. The control circuit according to claim 6, wherein the second pulse signal generation circuit comprises a relay and a driving circuit, and wherein the driving circuit is configured to receive the third pulse signal to drive the relay to output the second pulse signal.

8. The control circuit according to claim 1, wherein the current sensor is configured to generate the indication signal in response to a magnitude of the change in the input current exceeding 10%.

9. A testing apparatus for the liquid crystal display panel, comprising the control circuit according to claim 1.

10. The testing apparatus according to claim 9, wherein the testing apparatus comprises a voltage input port for receiving an external supply voltage and a voltage output port for providing a working voltage to the liquid crystal display panel to generate the input current, and wherein the current sensor is electrically connected between the voltage input port and the voltage output port to detect the change in the input current.

11. The testing apparatus according to claim 10, wherein the testing apparatus comprises an image signal output interface for being electrically connected to the liquid crystal display panel to provide an image signal to the liquid crystal display panel.

12. A method for testing a liquid crystal display panel, the liquid crystal display panel comprising a common electrode and a pixel electrode, wherein the method comprises:

providing an image signal to the liquid crystal display panel for image display;

detecting a change in an input current of the liquid crystal display panel to determine whether switching of image frames occurs; and discharging a liquid crystal capacitor comprising the common electrode and the pixel electrode in the liquid crystal display panel in response to detecting that switching of the image frames occurs.

13. The method according to claim 12, wherein the method further comprises:

detecting the change in the input current and generating a first pulse signal having a first duration by a current sensor, the first pulse signal indicating that switching of the image frames occurs, and generating a second pulse signal having a second duration equal to the first duration in response to generating the first pulse signal, the second pulse signal causing the liquid crystal capacitor to be discharged within the second duration.

14. The method according to claim 13, wherein the liquid crystal display panel comprises a discharge switch and a discharge control circuit connected in series with the liquid crystal capacitor, the method further comprising:

providing the second pulse signal to the discharge control circuit, wherein the discharge control circuit is configured to turn on the discharge switch in response to receiving the second pulse signal.

15. The method according to claim 14, further comprising:

generating a third pulse signal based on the first pulse signal prior to generating the second pulse signal, wherein a third duration of the third pulse signal is equal to the first duration; and generating the second pulse signal based on the third pulse signal, wherein a pulse amplitude of the second pulse signal is greater than a pulse amplitude of the third pulse signal.

16. The testing apparatus according to claim 9, wherein the indication signal is a first pulse signal having a first duration, wherein the discharge signal is a second pulse signal having a second duration equal to the first duration, and wherein the second pulse signal causes the liquid crystal capacitor to be discharged within the second duration.

17. The testing apparatus according to claim 16, wherein the control circuit further comprises a discharge control circuit that causes the liquid crystal capacitor to be discharged in response to receiving the second pulse signal.

18. The testing apparatus according to claim 17, wherein the discharge control circuit comprises a processor and a level selection circuit, wherein the level selection circuit comprises a first transistor and a second transistor, wherein a first terminal of the first transistor is electrically connected to a second terminal of the second transistor, wherein the second terminal of the second transistor is configured to receive a high level signal, a first terminal of the second transistor is configured to receive a low level signal, wherein control terminals of the first transistor and the second transistor are electrically connected to an output terminal of the processor, and wherein an input terminal of the processor is configured to receive the second pulse signal.

19. The testing apparatus according to claim 16, wherein the discharge signal generation circuit comprises a second pulse signal generation circuit and a third pulse signal generation circuit, wherein the third pulse signal generation circuit is configured to receive the first pulse signal to generate a third pulse signal, wherein the second pulse signal generation circuit is configured to receive the third pulse signal to generate the second pulse signal, wherein a third duration of the third pulse signal is equal to the first duration, and wherein a pulse amplitude of the second pulse signal is greater than a pulse amplitude of the third pulse signal.

20. The testing apparatus according to claim 19, wherein the third pulse signal generation circuit comprises an optical coupler and a first capacitor, wherein an input terminal of the optical coupler is configured to receive the first pulse signal, and wherein the first capacitor is electrically connected to an output terminal of the optical coupler.

* * * * *